United States Patent [19]

Schmerzler

[11] 4,094,169

[45] June 13, 1978

[54] EXPANDER-COMPRESSOR TRANSDUCER

[76] Inventor: Lawrence Jay Schmerzler, 539 Laurel Pl., South Orange, N.J. 07079

[21] Appl. No.: 417,958

[22] Filed: Nov. 21, 1973

Related U.S. Application Data

[63] Continuation of Ser. No. 59,306, Jul. 29, 1970, abandoned.

[51] Int. Cl.[2] ..... F25B 1/02; F04B 17/00

[52] U.S. Cl. ..... 62/498; 417/392

[58] Field of Search ..... 62/498, 467, 527; 91/234; 137/624.14; 417/377, 392

[56] References Cited

U.S. PATENT DOCUMENTS

| | | | |
|---|---|---|---|
| 1,486,486 | 3/1924 | Gates | 91/234 |
| 1,693,863 | 12/1928 | Potter | 62/527 |
| 3,301,471 | 1/1967 | Clarke | 417/392 |

*Primary Examiner*—William L. Freeh

[57] ABSTRACT

An Expander-Compressor Transducer is used in a gas or a vapor cycle refrigeration or a heat pumping system which operates in conjunction with a gas compressor, heat rejection heat exchangers, and heat absorption heat exchangers. The device utilizes the work of expansion of the fluid to partially compress the refrigerant after it has absorbed heat in the heat absorption heat exchanger thereby increasing the refrigerating capacity, extending the useful temperature range, and reducing the net input work of the conventional compressor. The new thermodynamic cycle has an improved Coefficient of Performance.

2 Claims, 6 Drawing Figures

EXPANDER-COMPRESSOR TRANSDUCER

This invention is filed as a continuing patent application to copending application, Serial Number 59,306, filed 7/29/70 now abandoned.

This invention relates to unique refrigeration, cryogenic, air conditioning, and heat pumping systems, more particularly and specifically, eliminating the conventional expansion mechanism and adding a novel Expander-Compressor Transducer for developing more efficient refrigeration.

Vapor compression refrigeration systems generally consist of a compressor, a condenser, a throttling expansion valve, and an evaporator. The compressor acts to bring the cold refrigerant fluid from a low pressure gas to a high pressure high temperature fluid. The condenser rejects the heat of compression to a cold sink usually air or cooling water while retaining high fuid pressure. The throttle expansion valve converts the cooled fluid from the high pressure liquid state to a low temperature fluid in the thermodynamic state known as a wet mixture. The evaporator absorbs heat from the region to be cooled while converting the wet mixture into a nominally saturated vapor just prior to entering the compressor and repeating the cycle. Other types of conventional refrigeration systems such as cryogenic, air or gas, or heat pumps, operate with similar thermodynamic functions.

My invention works in conjunction with the components of the conventional refrigeration system with the exception of the conventional expansion control mechanism which is eliminated.

With my invention, the fluid from the heat rejecting heat exchanger or the condenser expands in the expansion chamber of the expander-compressor transducer, then flows through the heat absorbing heat exchanger or evaporator, and thence back into the compression chamber of the expander-compressor transducer, thereby acting on the fluid both before and after it passes through the heat absorbing heat exchanger or evaporator, and thereafter returning to the compressor to increase the pressure of the fluid to complete the cycle for rejection of the heat at the heat rejecting heat exchanger. In a gas cycle configuration, the fluid flows from the heat rejecting heat exchanger through a regenerative heat exchanger before entering the expansion chamber and through the regenerative heat exchanger after leaving the compression chamber of the expander-compressor transducer, respectively. My invention operates to utilize the work output generated during the expansion process to precompress partially the fluid prior to its entering the suction side of the compressor. The invention reduces the net work input to the conventional compressor, increases the useful refrigerating capacity, and expands the useful operating temperature range with an improved Co-efficient of Performance, C.O.P. It can be operated with both air or gas and vapor compression refrigeration components.

My invention operates in conjunction with conventional refrigerants such as Freon, sulphur dioxide, air, helium, and other fluids and ordinary refrigerant componenets. The expander-compressor transducer therefore produces an essentially new thermodynamic cycle with a higher C.O.P. and a greater useful temperature range than is presently obtainable from conventional vapor compression systems.

Another object of my invention is to provide a simple and more efficient means of producing cryogenic temperatures in an open air cycle or gas refrigeration system remote from the source of atmospherically or water cooled compressed air or gas when used in a system with a conventional air compressor and heat exchangers.

It is therefore a primary object of this invention to provide a new and effective means of producing refrigeration.

Other objects and features of my invention will become apparent from the following detailed description of certain embodiments of construction, combination of elements, and arrangement of parts when considered with the accompanying drawing and the scope of the invention will be indicated in the claims.

Figure 3:
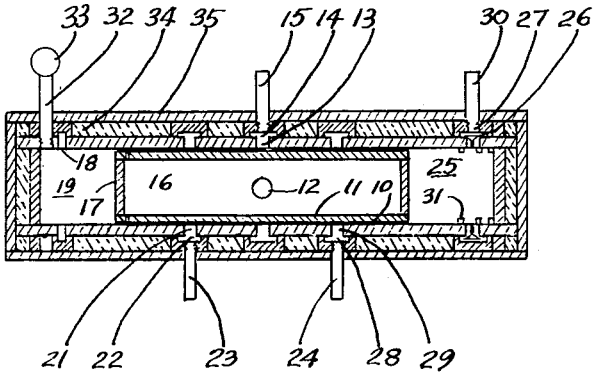
FIG. 3 is a longitudinal cross-section of the expander-compressor transducer showing the basic embodiments of my invention.
Figure 4:
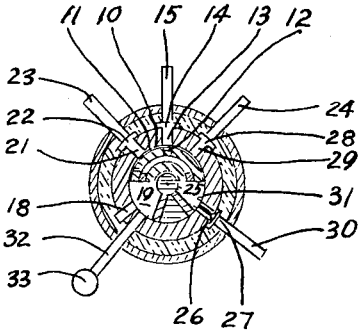
FIG. 4 is a cross-section of a rotary configuration of my invention.

FIG. 3 and FIG. 4 show alternate embodiments of the expander-compressor transducer with the unit incapsulated in thermal insulation 34 and contained within the structural housing 35. The structural housing 35 contains a series of connections: the starting control pipe 32 with the starting flow inlet valve 33, the high pressure inlet pipe 15 carrying the fluid from the regenerative heat exchanger, the expansion fluid outlet pipe 23 directing the fluid to the heat absorbing heat exchanger, the low pressure inlet pipe 24 receiving the fluid from the heat absorbing heat exchanger, and the fluid outlet pipe 30 directing the fluid through the regenerative heat exchanger.

Within the structural housing 35 is a fluid action chamber 10 and a piston 11 which oscillates by action of the communicating fluids therein. Piston 11 is a closed container with fluid inlet passages 12 located on the perimeter thereto to permit high pressure fluid passage when lined up with high pressure inlet ports 13 on the wall of the action chamber 10 from the high pressure inlet chamber 14 through the high pressure inlet pipe 15. High pressure inlet ports 13 are circumferentially placed 90° from the expansion chamber outlet ports 21 and low pressure inlet ports 29 around the fluid action chamber 10 to prevent the fluid from escaping through fluid inlet passages 12 to either expansion chamber outlet ports 21 or low pressure inlet ports 29 from passages 12 of piston 11.

From the passages 12 of piston 11, the fluid path continues through a series of outlet piston passages 16 on the perimeter near the piston head plate 17 when the piston 11 passes the passage chamber 18 to momentarily compress in the expansion chamber 19. Outlet piston passages 16 are peripherally positioned on piston 11 so that they never line up with expansion chamber outlet ports 21.

To maintain a fluid tight connection during oscillation and to prevent leakage, tolerances between piston 11 and fluid action chamber 10 are very close.

In cyclic operation, piston 11 moves within fluid action chamber 10 in oscillating motion. When piston 11 is in the extreme left position in the expansion chamber 19, high pressure fluid in the expansion chamber 19 moves the piston 11 to the right towards the compression chamber 25 causing spring means 31 and the low pressure gas in compression chamber 25 to be compressed. As piston 10 moves to the right, in sequence, low pressure inlet ports 29 are covered, closing off the entrance of low pressure fluid from the low pressure inlet chamber 28 and from low pressure inlet pipe 24. Next, piston inlet passages 12 communicate with high pressure inlet ports 13, allowing high pressure fluid from an exterior source to flow through high pressure inlet pipe 15 and high pressure inlet chamber 14 into and to pressurize passages 12 of piston 11. As piston 11 continues to move to the right, piston plate 17 uncovers expansion chamber outlet ports 21 allowing the expanded gas in expansion chamber 19 to flow through expansion outlet chamber 22 and expansion fluid outlet pipe 23 and into exterior heat absorbing heat exchanger or evaporator.

Simultaneously, as piston 11 moves to the right into compression chamber 25, the fluid pressure increases and causes the compressed fluid outlet check valves 26 to open, allowing the compressed fluid to flow into the outlet compressed fluid chamber 27, and out through the compressed fluid outlet pipe 30.

The energy stored and the compressed fluid in compression chamber 25 eventually stops and reverses the motion of piston 11. In cyclic operation, as piston 11 moves from the extreme right hand position to the left, the compressed fluid outlet check valves 26 close and the pressure of the fluid in compression chamber 25 reduces. As piston 11 continues its movement to the left, low pressure inlet ports 29 again are uncovered allowing low pressure fluid to flow into compression chamber 25 through low pressure inlet pipe 24 through low pressure inlet chamber 28 through low pressure inlet ports 29.

As piston 11 moves from right to left further, high pressure fluid again flows from the exterior source into piston 11 through piston inlet passages 12 to maintain the high pressure in the interior of piston 11. The continued motion of piston 11 to the left into the expansion chamber 19 causes the fluid therein to be compressed. At the extreme left position of piston 11 in expansion chamber 19, high pressure fluid is partially released when piston outlet passages 16 communicate with passage chamber 18 allowing a portion of the compressed gases to flow into expansion chamber 19, thereby causing piston 11 eventually to stop and to reverse its direction of motion towards the low pressure chamber 25.

For starting purposes, a one shot momentary burst of high pressure fluid is permitted to enter the expansion chamber 19 from the starting flow inlet valve 33 through starting control pipe 32 with piston 11 initially in some stationary position. Piston 11 then moves towards the compression chamber 25 initiating the normal cycle. Spring means 31 assures that piston 11 will always be initiated from a minimum volume position at start up.

The expander-compressor transducer cycle operates through the introduction of a high pressure fluid, vapor, gas, or air, from an external source, through passages 12 of piston 11 to a varying volume in the fluid action chamber 10, a high pressure in the expansion chamber 19, and a low pressure in compression chamber 25, respectively. The fluid expands in the expansion chamber 19, driving piston 11 into oscillating motion, permitting the fluid to flow by the self-regulating fluid actuated control from expansion chamber 19 through an external heat absorption heat exchanger or evaporator to a lower pressure in compression chamber 25, absorbing heat in the process.

The fluid is further compressed in compression chamber 25, raising the pressure to slightly above the level of the inlet pressure of the exterior conventional compressor in the case of a closed refrigeration system or slightly above atmospheric pressure in the case of an open cycle using gas or air. The expander-compressor transducer is adjusted to result in oscillating motion to produce expansion work equivalent to compression work with allowance for friction and other losses. It will of course be understood that the low pressure fluid exiting from the compression chamber 25 may exhaust through heat exchanger conduits to atmosphere in the case of an open cycle or return to the exterior system by way of suitable conduits or regenerative heat exchangers which leads to the inlet side of the compressor in the case of a closed cycle.

Figure 2:
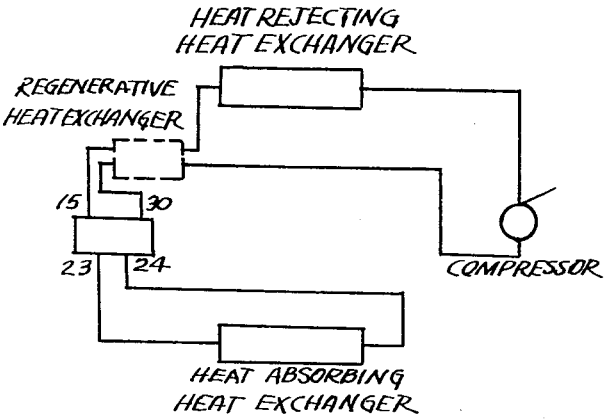
FIG. 2 is a schematic diagram showing my invention in place replacing the irreversible expansion device. The fluid flow direction is indicated.

In FIG. 2, the high pressure fluid from the conventional compressor flows into and is cooled by the conventional heat rejecting heat exchanger and thence into the regenerative heat exchanger for additional cooling. Thereafter the fluid enters my invention where it is expanded to a low pressure low temperature condition. Then the fluid flow through a conventional heat absorbing heat exchanger receiving energy therefrom before returning to my invention for partial compression prior to passing through the regenerative heat exchanger where the fluid absorbs additional energy increasing its temperature for return to the suction side of the conventional compressor.

Figure 5:
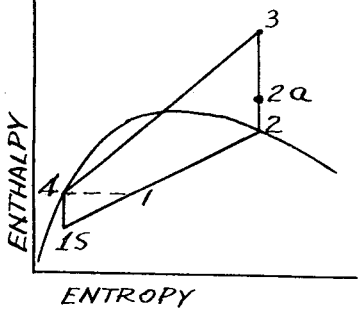
FIG. 5 is an enthalpy-entropy diagram for an illustrative cycle comparing a conventional vapor cycle refrigeration or heat pump with a cycle diagram utilizing my invention.

An illustrative example as shown in FIG. 5 of the improved performance obtained in the embodiment of my invention in a vapor cycle refrigeration system is herein described for comparison with a standard vapor cycle refrigeration system. The calculations assume the use of diclorodifloromethane refrigerant in both instances, with a nominal condensing saturation temperature and pressure of 120° F and 172 psia, respectively, with no subcooling of the condensed fluid and a nominal evaporator temperature and pressure of 0° F. and 24 psia, respectively, with saturated vapor leaving the evaporator. The cycle being compared assume ideal processes with no frictional fluid pressure losses in the conduits or heat exchangers and no mechanical frictional losses.

In the illustrative conventional ideal thermodynamic vapor cycle, the saturated liquid fluid is irreversibly expanded through a throttling valve into the heat absorbing heat exchanger or evaporator at a constant enthalpy of 36.2 BTU/lb creating a cold wet fluid mixture at the stated low evaporator temperature and pressure. The wet mixture then flows through the evaporator exiting as a saturated vapor having an enthalpy of 78.2 BUT/lb. The resulting useful refrigeration is 42 BTU/lb. The saturated vapor is then compressed ideally isentropically to 172 psia with an enthalpy of 94 BTU/lb. The resulting work required by the compressor is 15.8 BTU/lb. Thus the C.O.P. is 42/15.8 or 2.7.

In my cycle, starting with the same condensed fluid state as in the previous illustration with saturated Freon at 172 psia and 120° F and an enthalpy of 36.2 BTU/lb. the fluid is ideally isentropically expanded in the expansion chamber 19 to the evaporator pressure of 24 psia with an enthalpy of 32.2 BTU/lb. This wet mixture then flows through the evaporator similarly exiting as a saturated vapor as in the previous instance and having an enthalpy of 78.2 BTU/lb.

This saturated vapor then enters the compression chamber 25 using the prior work output of the fluid expanding in the expansion chamber 19 increasing its pressure and exiting at an enthalpy of 82.2 BTU/lb. These actions result in zero net work output.

The refrigerant then is compressed isentropically in a conventional compressor exiting at the same thermodynamic state as the conventional cycle and having an enthalpy of 94 BTU/lb. The refrigeration obtained in the evaporator is 46 BTU/lb and the work required in the compressor is 11.8 BTU/lb. The resultant C.O.P. is equal to 46/11.8 = 3.9. The C.O.P. is thus improved over conventional refrigeration vapor cycles by (3.9 – 2.7)/2.7 = .45 or 45%.

Whereas the above comparison is made for idealized thermodynamic processes, it is nevertheless representative of actual cycles.

Figure 1:
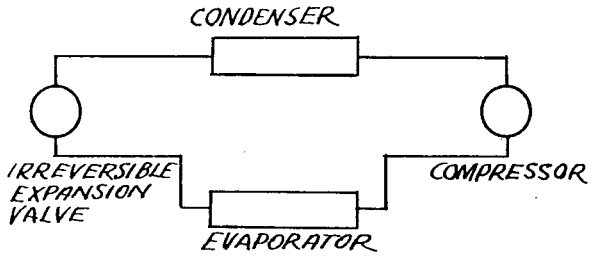
FIG. 1 is a schematic diagram illustrating a conventional refrigeration or heat pumping system in which the novel expander-compressor transducer can be utilized by replacing the irreversible expansion device.
Figure 6:
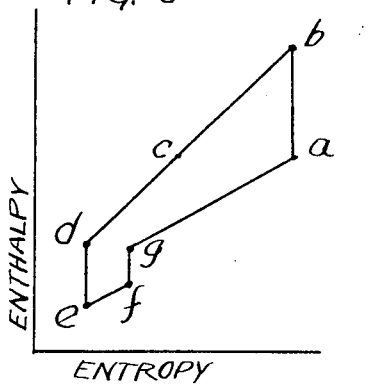
FIG. 6 is another enthalpy-entropy diagram showing an air or gas cycle with my invention. In a gas cycle, configuration, the fluid flows from the heat rejecting heat exchanger through a regenerative heat exchanger before entering my invention and through the regenerative heat exchanger after leaving the compression chamber of my invention.

An illustrative example of the embodiment of my invention is shown in FIG. 2 and FIG. 6 with the application of the regenerative heat exchanger for the air or gas cycles. High pressure high temperature air or gas flows from the conventional compressor (point *b*) through the heat rejecting heat exchanger and exiting (point *c*) where it is cooled. The Fluid enters the regenerative heat exchanger where the fluid is further cooled before entering my invention (point *d*). The cooled expanded gas leaves my invention (point *e*) and absorbs heat from the heat absorbing heat exchanger and exiting (point *f*) before returning to my invention for partial compression and exiting (point *g*). The compressed fluid flows through the regenerative heat exchanger and returns to the suction side of the compressor (point *a*) for recycling. In an open air cycle, the compressor will draw filtered ambient air from the atmosphere as the working fluid. This air will be exhausted to the atmosphere rather than returning to the suction side of the compressor for recycling after exiting from my invention.

In a conventional vapor compression refrigerator, it is known that the useful temperature difference between the subcooled liquid fluid leaving the condenser and the evaporator temperature is limited by the irreversible isenthalpic expansion process occuring during the throttling process in the throttling valve. As the temperature difference between the condenser and the evaporator increases, the resultant refrigerating effect can and does approach zero. This effect occurs in both refrigerators and in air conditioners when the ambient air temperature increases above design limits resulting in high work input to the compressor and reduced refrigeration. This is extremely wasteful. As such, in addition to being an energy wasting effect, this temperature difference limitation likewise restrict the use of heat pumping devices to mild climates.

My invention eliminates this wasteful irreversible isenthalpic expansion process known as a throttling process occuring in the throttling valve and replaces it with a nominally reversible expansion process known as an isentropic process. As such, this reversible expansion, in addition to producing net output work, also increases the amount of useful refrigeration by an amount equal to the amount of useful work output. Thus this expansion provides a double benefit. The output work of the reversible expansion is utilized in my invention to precompress refrigerant fluid prior to entering the compressor on exiting via a heat exchanger to the ambient air in the open gas cycle for cryogenic applications wherein the low temperature heat absorbing heat exchanger is remote from the compressor.

While the specific embodiments of my invention has been shown and described in detail to illustrate the invention, it will be understood that the invention may be embodied otherwise, that certain changes are possible without departing from the scope of the invention; and it is intended that all matter contained in the above description herein shall be interpreted as illustrative and not in a limited sense.

I claim:

1. An expander-compressor transducer for expanding refrigerant fluid from a high pressure source into a low pressure heat absorbing heat exchanger while simultaneously precompressing the same fluid stream drived from the low pressure heat absorbing heat exhanger for delivery through suitable conduit heat exchangers to the suction side of the high pressure source, comprising a body member enclosing a chamber for confinement of a refrigerant fluid.

fluid responsive piston means arranged to oscillate in said chamber and dividing said chamber into an expansion chamber at one end and a compression chamber at the other end, return spring control means in said compression chamber for locating said piston means into initial start-up position, fluid control regulating means for permitting flow of referigerant fluid into and out of said expansion chamber and into said compression chamber, and check valve means for permitting refrigerant flow out of said compression chamber whenever the pressure in said compression chamber is higher than the fluid pressure immediately downstream of said check valve means.

thereby effecting oscillatory movement of said fluid responsive piston means within said chamber, causing concurrently the refrigerant fluid stream to expand in said expansion chamber and to compress in said compression chamber, and producing simultaneously a cooling effect and a work output.

2. An expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising an expansible chamber, fluid responsive piston means arranged to oscillate in said chamber and dividing said chamber into an expansion chamber and a compression chamber, return spring control means in said compression chamber for locating said piston into initial start-up position, fluid passage control means for supplying refrigerant fluid into said expansion chamber, check valve means for permitting refrigerant flow out of said compression chamber whenever the pressure in said compression chamber is higher than the fluid pressure immediately downstream of said check valve means, fluid output and fluid input means for controlling the flow of refrigerant fluid to and from said expansion chamber and for controlling the flow of refrigerant fluid to said compression chamber.

* * * * *